US008747575B2

(12) United States Patent
Hashizume et al.

(10) Patent No.: US 8,747,575 B2
(45) Date of Patent: Jun. 10, 2014

(54) 655 MPA GRADE MARTENSITIC STAINLESS STEEL HAVING HIGH TOUGHNESS AND METHOD FOR MANUFACTURING THE SAME

(75) Inventors: Shuji Hashizume, Kanagawa (JP); Yusuke Minami, Kanagawa (JP); Tatsuo Ono, Kanagawa (JP)

(73) Assignee: NKKTUBES, Kanagawa (JP)

( * ) Notice: Subject to any disclaimer, the term of this patent is extended or adjusted under 35 U.S.C. 154(b) by 529 days.

(21) Appl. No.: 12/649,399

(22) Filed: Dec. 30, 2009

(65) Prior Publication Data

US 2010/0096048 A1 Apr. 22, 2010

Related U.S. Application Data

(63) Continuation of application No. 11/720,351, filed as application No. PCT/JP2004/018710 on Dec. 15, 2004, now abandoned.

(51) Int. Cl.
*C22C 38/44* (2006.01)
*C21D 8/02* (2006.01)

(52) U.S. Cl.
USPC ..... 148/325; 148/608; 148/654; 148/663; 420/67

(58) Field of Classification Search
USPC ..... 148/325, 593, 654, 663, 608; 420/67, 420/69
See application file for complete search history.

(56) References Cited

FOREIGN PATENT DOCUMENTS

| | | |
|---|---|---|
| JP | 2001-059143 | 3/2001 |
| JP | 2001-226749 | 8/2001 |
| JP | 2004-115890 | 4/2004 |

OTHER PUBLICATIONS

English translation (for paragraph 3) and Japanese Article of Hitoshi Asahi, Alloy Design Concept of High Alloy Steels Used for Seamless Pipe Based on Mechanism of Hot Workability, Mar. 1993, vol. 6, No. 2, p. 360-363.

*Primary Examiner* — Deborah Yee
(74) *Attorney, Agent, or Firm* — Lucas & Mercanti, LLP

(57) ABSTRACT

A martensitic stainless steel for inexpensive seamless pipe having 655 MPa yield strength, high toughness and excellent corrosion resistance in high $CO_2$ environments, and a method for manufacturing thereof is provided. The steel comprises C: 0.005-0.05%, Si: 0.1-0.5%, Mn: 0.1-2.0%, P: −0.05%, S: −0.005%, Cr: 10.0-12.5%, Mo: 0.1-0.5%, Ni: 1.5-3.0%, N: −0.02%, Al: 0.01-0.1%, by weight, while FI value defined by the formula [FI=Cr+Mo−Ni−30(C+N)] being 5.00 to 8.49, and balance of substantially Fe. The method comprises the steps of reheating the cooled steel at temperatures from 780° C. to 960° C., quenching the reheated steel, and then tempering the quenched steel at temperatures from 550° C. to 650° C.

7 Claims, No Drawings

655 MPA GRADE MARTENSITIC STAINLESS STEEL HAVING HIGH TOUGHNESS AND METHOD FOR MANUFACTURING THE SAME

CROSS REFERENCE TO RELATED APPLICATIONS

This is a Continuation Application of U.S. application Ser. No. 11/720,351, filed May 29, 2007, now abandoned which was a 371 of PCT/JP2004/18710 filed Dec. 15, 2004, the entire contents of both Applications are hereby incorporated by reference.

FIELD OF THE INVENTION

The present invention relates to a martensitic stainless steel as OCTG used in oil wells or gas wells, and to a method for manufacturing thereof, specifically the present invention relates to a martensitic stainless steel for inexpensive seamless pipes having 655 MPa yield strength and high toughness, suitable for the uses in high $CO_2$ environments, and a method for manufacturing thereof.

BACKGROUND OF THE INVENTION

In recent years, there has been progressing the exploitation of oil wells and gas wells under various environments, including very deep wells, high temperature and high pressure gas wells, and wells in cold region. Accordingly, there are also aroused the problems of corrosion under high $CO_2$ environments and, for an oil well generating $H_2S$, of sulfide stress corrosion cracking (SSC) caused by $H_2S$. As a result, there is an increased demand of steel pipes having both the 552 MPa or higher yield strength and the high toughness, necessary for OCTG for deep wells enduring above-described severe corrosion environments.

Conventional OCTG materials are 410 Steel or 420 Steel specified by the American Iron and Steel Institute (AISI). Although these grades of steels are relatively inexpensive and achieve 552 MPa or higher yield strength by heat treatment, they do not have satisfactory corrosion resistance and toughness. Furthermore, since these steels contain carbon by about 0.1% or more by weight, they cannot be treated by water-cooling in the manufacturing process, which degrades the production efficiency.

Regarding the martensitic stainless steel having above-described strength, high toughness, and high corrosion resistance, and regarding the method for manufacturing thereof, there are several proposals.

For instance, Patent Literature 1, (Japanese Patent No. 2665009), discloses a steel containing 0.005 to 0.04% C, 12.0 to 17.0% Cr, and 1.5 to 6.0% Ni, by weight, and a method for manufacturing thereof. Although the steel has 784 to 1078 MPa yield strength (proof stress), which is higher than that of general-use 552 MPa grade and 655 MPa grade steels, and although the steel gives favorable corrosion resistance in a 65% nitric acid corrosion test, the steel is not examined for corrosion resistance under high $CO_2$ environments. Patent Literature 2, (Japanese Patent No 2091532), discloses a steel containing 0.15% or less C, 9 to 16.0% Cr, and 0.2 to 2.5% Ni, by weight, and a method for manufacturing thereof. Since, however, the manufacturing of the steel needs controlled rolling, the method has a problem in the efficiency of manufacturing process, and has a limitation on the manufacturing facilities. Patent Literature 3, (Japanese Patent No. 2995524), discloses a steel containing 0.03% or less C, 11 to 17% Cr, and 3.5 to 7.0% Ni, by weight, and a method for manufacturing thereof. Since, however, the steel needs to add 3.5% or more Ni, the steel is not advantageous in economy. Patent Literature 4, (JP-A-2004-115890), (the term "JP-A" referred to herein signifies the "Japanese Patent Laid-Open No."), discloses a low-Ni steel containing 0.05% or less C, 10 to 12.5% Cr, and 1.5 to 3.0% Ni, by weight, and a method for manufacturing thereof. The steel is, however, limited to 552 MPa grade strength because these materials as shown above rapidly degrade properties such as toughness and SSC resistance if the strength exceeds 552 MPa grade. Patent Literature 5, (JP-A-2004-99964), discloses a low Ni—Nb steel containing 0.02 to 0.05% C, 10 to 12% Cr, 1.5 to 3.0% Ni, and 0.005 to 0.10% Nb, by weight, and a method for manufacturing thereof. The steel is, however, limited to 758 MPa grade of strength.

[Patent Literature 1] Japanese Patent No. 2665009
[Patent Literature 2] Japanese Patent No. 2091532
[Patent Literature 3] Japanese Patent No. 2995524
[Patent Literature 4] JP-A-2004-115890
[Patent Literature 5] JP-A-2004-99964

DISCLOSURE OF THE INVENTION

Problems to be Solved by the Invention

As described above, conventional technologies cannot provide OCTG pipes suitable for the use under high $CO_2$ environments, having 655 to 758 MPa yield strength and high toughness, and giving excellent economy. The inventors of the present invention conducted various studies to solve the above-described problems of conventional technologies, and invented a martensitic stainless steel for seamless pipes having 655 MPa grade yield strength, 200 J or higher satisfactory toughness even at low temperature of −40° C., suitable for the uses in high $CO_2$ environments and giving excellent economy, and a method for manufacturing thereof, thus completed the present invention.

Means for Resolution

Specifically, the inventors of the present invention improved corrosion resistance and toughness by suppressing the precipitation of carbide through the control of C content to a low level, thereby allowed to apply water-cooling in the manufacturing process. With the limitation of C content, the inventors of the present invention found that the corrosion resistance is maintained to the level of conventional steels even when the Cr content is reduced to below 13% which is the content in conventional 420 Steel and the like. Furthermore, along with the limitation of Cr content, the Ni content is reduced to about 2% to reduce the cost. In addition, the inventors of the present invention found that the addition of small amount of Mo provides the steel with stable toughness durable for the use in cold region, for example, at −40° C.

In the course of completing the present invention, the inventors of the present invention investigated the optimum balance of chemical compositions and heat treatment conditions in terms of strength-toughness-corrosion resistance under high $CO_2$ environment by varying the heat treatment conditions of quenching and tempering after the hot-rolling of steel having different chemical compositions. Through the investigation, a martensitic stainless steel for seamless pipes having 655 MPa grade of yield strength suitable for the use under high $CO_2$ environments was obtained by controlling the chemical compositions and the heat treatment conditions in a specific range according to the present invention.

The 655 MPa grade martensitic stainless steel having high toughness and the method for manufacturing thereof according to the present invention have been completed on the basis of the above-described findings, and the essence thereof is the following.

A 655 MPa grade martensitic stainless steel having high toughness according to a first aspect of the present invention is a steel having high toughness, comprising C: 0.005-0.05%, Si: 0.1-0.5%, Mn: 0.1-2.0%, P: −0.05%, S: −0.005%, Cr: 10.0-12.5%, Mo: 0.1-0.5%, Ni: 1.5-3.0%, N: −0.02%, Al: 0.01-0.1%, by weight, while FT value defined by the formula [FI=Cr+Mo−Ni−30(C+N)] being 5.00 to 8.49, and balance of substantially Fe.

A 655 MPa grade martensitic stainless steel having high toughness according to a second aspect of the present invention is a steel having the chemical compositions of the first aspect thereof, further comprising at least one chemical composition selected from the group consisting of Cu: −0.5%, Nb: −0.05%, V: −0.1%, B: −0.005%, Ca: −0.005%, by weight.

A method for manufacturing a 655 MPa grade martensitic stainless steel having high toughness according to a third aspect of the present invention, comprising the steps of: hot-rolling a steel comprising 0.005-0.05% C, Si: 0.1-0.5%, Mn: 0.1-2.0%, P: −0.05%, S: −0.005%, Cr: 10.0-12.5%, Mo: 0.1-0.5%, Ni: 1.5-3.0%, N: −0.02%, Al: 0.01-0.1%, by weight, while FI value defined by the formula [FI=Cr+Mo−Ni−30(C+N)] being 5.00 to 8.49, and balance of substantially Fe; cooling the hot-rolled steel; reheating the cooled steel at temperatures from 780° C. to 960° C.; quenching the reheated steel; and then tempering the quenched steel at temperatures from 550° C. to 650° C.

A method for manufacturing 655 MPa grade martensitic stainless steel having high toughness according to a fourth aspect of the present invention, comprising the steps of: hot-rolling the steel having the chemical compositions of the third aspect thereof further comprising at least one chemical composition selected from the group consisting of Cu: −0.5%, Nb: −0.05%, V: −0.1%, B: −0.005%, Ca: −0.005%, by weight, cooling the hot-rolled steel; reheating the cooled steel at temperatures from 780° C. to 960° C.; quenching the reheated steel; and then tempering the quenched steel at temperatures from 550° C. to 650° C.

DETAILED DESCRIPTION FOR CARRYING OUT THE INVENTION

The following is the description about the reasons for limiting the chemical compositions and the manufacturing conditions according to the present invention to above-described ranges. The percentage of individual chemical compositions signifies percentage by weight.

C: 0.005 to 0.05%

Carbon increases the strength of steel by enhancing solid solution, by hardening the transformed martensite, and by precipitation hardening as carbide. If the C content is in this range, the effect of increasing the strength of steel is attained, and both the toughness and the corrosion resistance are maintained to a favorable level. In particular, decrease in the C content to the level of the present invention suppresses the precipitation of carbide in the steel so that the corrosion resistance under high $CO_2$ environments becomes high.

Si: 0.1 to 0.5%

Silicon inevitably exists in steel as a deoxidizing element. If the Si content is in this range, the deoxidizing effect is attained and the toughness is maintained.

Mn: 0.1 to 2.0%

Manganese inevitably exists as a deoxidizing element in steel, similar with Si. If the Mn content is in this range, the deoxidizing effect is attained and the toughness is maintained.

P: 0.05% or Less

Since phosphorus is an impurity element and induces degradation of toughness, lower P content is more preferable. If the P content is in this range, the degradation of toughness is suppressed.

S: 0.005% or Less

Sulfur is an impurity element similar with P, and induces degradation of toughness and hot-workability. Accordingly, lower S content is more preferable. If the S content is in this range, the degradation of toughness and hot-workability is suppressed.

Cr: 10.0 to 12.5%

Chromium has an effect of improving the corrosion resistance. If the Cr content is in this range, satisfactory corrosion resistance is attained even when C content is low, from 0.005% to 0.05%. If the Cr content exceeds this range, the effect of increasing the corrosion resistance saturates, which is not advantageous in terms of economy. Preferably the Cr content is in a range from 10.0% or more to less than 12.0%, and more preferably from 11.0% or more to less than 12.0%.

Mo: 0.1 to 0.5%

Molybdenum has effects to limit the precipitation sites and the kinds of precipitates and to improve the toughness. In particular, if the quantity of precipitate of $Cr_2(C, N)$ and $M_7C_3$ is less than the quantity of precipitate of $M_{23}C_6$, effective increase in toughness is available. If the Mo content is in this range, the effect of improving toughness is attained. Excess addition of Mo above the range is unfavorable in terms of δ-ferrite formation and of economy. Preferably the Mo content is from 0.15 to 0.40%.

Ni: 1.5 to 3.0%

Nickel has an effect to improve the corrosion resistance and the toughness. If the Ni content is in this range, the δ-ferrite formation is suppressed, which gives favorable hot-workability. Excess addition of Ni above the range is not advantageous because the effect of improving the toughness saturates. Preferably the Ni content is in a range from 2.0 to 3.0%.

N: 0.02% or Less

Nitrogen has an effect of strength-increase by the enhancement of solid solution and by the precipitation hardening. Excess addition of N above the range induces binding N with V, Nb, Ti, and the like to form coarse precipitates, which degrades the toughness and hot-workability. Therefore, excess addition of N is not advantageous.

Al: 0.01 to 0.1%

Aluminum inevitably exists in steel as a deoxidizing element. If the Al content is in this range, the effect of deoxidization is attained, and the formation of AlN which precipitates in grain boundaries to decrease the grain boundary strength is suppressed, thus to degrade the toughness.

FI Value: 5.00 to 8.49%

The FI is defined by the following formula:

$$FI=Cr+Mo-Ni-30(C+N)$$

The FI is a parameter of formation of δ-ferrite. The coefficient is selected in accordance with Schaefler diagram. If the FI value is not more than 8.49%, toughness becomes favorable because the formation of δ-ferrite is suppressed.

Balance of the components is substantially Fe. The phrase "substantially Fe" referred to herein means that the steel of the present invention may allow the existence of gas components of O and H, and impurities such as Sn, As, and Sb, both of which are inevitably contained in the steel during melting and refining process in the range not affect the purpose of the present invention.

According to the present invention, the steel may further contain at least one chemical composition selected from the group consisting of Cu, Nb, V, B, and Ca to improve strength, toughness, corrosion resistance, and hot-workability. The reasons to limit these chemical compositions are described in the following.

Cu: 0.5% or Less

Copper has an effect of increasing the corrosion resistance. If the Cu content is in this range, no problem of degradation of hot-workability and other characteristics occurs.

Nb: 0.05% or Less

Niobium refines austenitic grains by the Nb-carbide precipitation during quenching thus to improve the toughness, and can increase the strength by fine Nb-carbide precipitated during tempering. If the Nb content is in this range, the increase in the strength by the precipitation of Nb-carbide is controlled to an appropriate range.

V: 0.1% or Less

Vanadium has an effect of forming nitride with N, thus increasing the strength. If the V content is in this range, the effect of increasing the strength does not saturate, and the degradation of toughness caused by the formation of coarse precipitates is not induced, so the strength increases without degrading the toughness.

B: 0.005% or Less

Boron has an effect of grain boundary strengthening. If the B content is in this range, no low-melting compound is formed at grain boundaries so that the grain boundaries are strengthened while maintaining the hot-workability.

Ca: 0.005% or Less

Calcium has an effect to control the morphology of manganese sulfide inclusion and to improve the toughness and the corrosion resistance. If the Ca content is in this range, the formation of Ca-based precipitate is suppressed, thereby to improve the toughness and the corrosion resistance.

The manufacturing conditions are described below.

Temperature of heating for quenching: 780° C. to 960° C.

If the heating temperature for quenching is in this range, a fully austenitic single-phase microstructure is attained during heating so that the succeeding cooling (quenching) gives martensite-single phase microstructure to provide a stable quenched microstructure, as well as suppressing the formation of coarse austenitic grains, thus attaining favorable toughness.

Tempering Temperature: 550° C. to 650° C.

Since the steel according to the present invention has high strength and insufficient toughness in as-quenched state, appropriate tempering is required. If the tempering temperature is in this range, desirable strength is attained and the toughness becomes favorable.

The martensitic stainless steel according to the present invention may be prepared by any melting and refining process such as LD converter or electric furnace, which can control the chemical compositions within the range of the present invention. When the steel is used as OCTG, the steel is formed into billet or other required shape by casting or rolling thereof, and then is subjected to a process such as piercing using a piercer with extrusion stem or a piercing mill with inclined roll, or rolling to form seamless steel pipes, followed by specified heat treatment.

The martensitic stainless steel according to the present invention is applicable to other usage other than OCTG. For example, the steel may be used as transportation steel pipes such as line pipes. In that case, the ingoted steel is formed into slab shape by casting or rolling, and it is rolled into steel plate using a plate mill or a hot-strip mill, and then is subjected to a specified heat treatment, followed by welding to manufacture the steel pipes. Alternatively, the rolled steel plate may be formed into steel pipe by welding thereof, followed by a specified heat treatment such as quenching and tempering.

The martensitic stainless steel according to the present invention is subjected to reheating and quenching after hot-rolling. If, however, a direct quenching apparatus which can apply direct quenching to the steel after hot-rolling is available, direct quenching may be applied instead of reheating and quenching, followed by specified tempering.

EXAMPLES

Table 1 shows the chemical compositions of the working examples (Nos. 1-17) according to the present invention. Table 2 shows the results of mechanical properties thereof. Table 3 shows the chemical compositions of the comparative examples (Nos. 18-35). Table 4 shows the results of mechanical properties.

TABLE 1

| | | Chemical Compositions (wt %) | | | | | | | | | | | | Quenching Temp. | Tempering Temp. |
|---|---|---|---|---|---|---|---|---|---|---|---|---|---|---|---|
| | No. | C | Si | Mn | P | S | Cr | Mo | Ni | N | Al | Others | FI, % | (° C.) | (° C.) |
| Steels of the present invention | 1 | 0.033 | 0.19 | 0.20 | 0.011 | 0.003 | 11.8 | 0.19 | 2.65 | 0.014 | 0.051 | — | 7.93 | 850 | 650 |
| | 2 | 0.033 | 0.19 | 0.20 | 0.011 | 0.003 | 11.8 | 0.19 | 2.65 | 0.014 | 0.051 | — | 7.93 | 800 | 650 |
| | 3 | 0.033 | 0.19 | 0.20 | 0.011 | 0.003 | 11.8 | 0.19 | 2.65 | 0.014 | 0.051 | — | 7.93 | 800 | 625 |
| | 4 | 0.033 | 0.20 | 0.21 | 0.010 | 0.003 | 11.8 | 0.37 | 2.63 | 0.015 | 0.049 | — | 8.10 | 850 | 650 |
| | 5 | 0.033 | 0.20 | 0.21 | 0.010 | 0.003 | 11.8 | 0.37 | 2.63 | 0.015 | 0.049 | — | 8.10 | 800 | 650 |
| | 6 | 0.033 | 0.20 | 0.21 | 0.010 | 0.003 | 11.8 | 0.37 | 2.63 | 0.015 | 0.049 | — | 8.10 | 800 | 625 |
| | 7 | 0.029 | 0.20 | 0.21 | 0.006 | 0.002 | 11.6 | 0.18 | 2.20 | 0.015 | 0.040 | — | 8.26 | 850 | 625 |
| | 8 | 0.029 | 0.20 | 0.21 | 0.006 | 0.002 | 11.6 | 0.18 | 2.20 | 0.015 | 0.040 | — | 8.26 | 800 | 625 |
| | 9 | 0.029 | 0.20 | 0.21 | 0.006 | 0.002 | 11.6 | 0.18 | 2.20 | 0.015 | 0.040 | — | 8.26 | 800 | 600 |
| | 10 | 0.032 | 0.20 | 0.21 | 0.010 | 0.002 | 11.8 | 0.38 | 2.32 | 0.015 | 0.048 | — | 8.45 | 850 | 650 |
| | 11 | 0.032 | 0.20 | 0.21 | 0.010 | 0.002 | 11.8 | 0.38 | 2.32 | 0.015 | 0.048 | — | 8.45 | 800 | 625 |
| | 12 | 0.032 | 0.20 | 0.21 | 0.010 | 0.002 | 11.8 | 0.38 | 2.32 | 0.015 | 0.048 | — | 8.45 | 800 | 600 |
| | 13 | 0.032 | 0.20 | 0.21 | 0.008 | 0.002 | 11.6 | 0.21 | 2.38 | 0.015 | 0.055 | 0.3Cu | 8.02 | 800 | 625 |
| | 14 | 0.032 | 0.20 | 0.21 | 0.008 | 0.002 | 11.6 | 0.21 | 2.38 | 0.015 | 0.055 | 0.02Nb | 8.02 | 800 | 625 |
| | 15 | 0.033 | 0.20 | 0.21 | 0.006 | 0.002 | 11.6 | 0.23 | 2.35 | 0.015 | 0.052 | 0.07V | 8.04 | 800 | 650 |
| | 16 | 0.033 | 0.20 | 0.21 | 0.006 | 0.002 | 11.6 | 0.23 | 2.35 | 0.015 | 0.052 | 0.003B | 8.04 | 800 | 625 |
| | 17 | 0.033 | 0.20 | 0.21 | 0.006 | 0.002 | 11.6 | 0.23 | 2.35 | 0.015 | 0.052 | 0.003Ca | 8.04 | 800 | 625 |

TABLE 2

| | No. | Yield strength (MPa) | vE-40 (J) | Corrosion rate (mm/y) | Total Evaluation |
|---|---|---|---|---|---|
| Steels of the present invention | 1 | 668 | 226 | 0.05 | ○ |
| | 2 | 680 | 274 | 0.05 | ○ |
| | 3 | 713 | 253 | 0.03 | ○ |
| | 4 | 676 | 265 | 0.03 | ○ |
| | 5 | 668 | 281 | 0.04 | ○ |
| | 6 | 717 | 267 | 0.03 | ○ |
| | 7 | 676 | 213 | 0.06 | ○ |
| | 8 | 669 | 277 | 0.07 | ○ |
| | 9 | 690 | 269 | 0.06 | ○ |
| | 10 | 679 | 276 | 0.06 | ○ |
| | 11 | 694 | 302 | 0.04 | ○ |
| | 12 | 724 | 292 | 0.05 | ○ |
| | 14 | 690 | 243 | 0.05 | ○ |
| | 15 | 703 | 255 | 0.05 | ○ |

TABLE 2-continued

| No. | Yield strength (MPa) | vE-40 (J) | Corrosion rate (mm/y) | Total Evaluation |
|---|---|---|---|---|
| 16 | 712 | 247 | 0.05 | ○ |
| 17 | 699 | 271 | 0.03 | ○ |
| 18 | 710 | 249 | 0.04 | ○ |

the samples were tested by tensile tester to determine the yield strength. As for the toughness, full-size V-notch Charpy test samples were cut from the center portion in the thickness direction of the plate, and the samples were tested by impact tester at −40° C. to evaluate the absorbed energy. For the corrosion resistance, samples were immersed in a 10% NaCl aqueous solution equilibrated with 30 bar carbon dioxide gas at 100° C. for 336 hours, and the corrosion loss was evaluated.

TABLE 3

| | No. | Chemical Compositions (wt %) | | | | | | | | | | | FI, % | Quenching Temp. (° C.) | Tempering Temp. (° C.) |
|---|---|---|---|---|---|---|---|---|---|---|---|---|---|---|---|
| | | C | Si | Mn | P | S | Cr | Mo | Ni | N | Al | Others | | | |
| Steels of the comparative example | 18 | 0.033 | 0.19 | 0.20 | 0.011 | 0.003 | 11.8 | 0.19 | 2.65 | 0.014 | 0.051 | - | 7.93 | 850 | **750** |
| | 19 | 0.033 | 0.19 | 0.20 | 0.011 | 0.003 | 11.8 | 0.19 | 2.65 | 0.014 | 0.051 | - | 7.93 | 800 | **525** |
| | 20 | 0.033 | 0.20 | 0.21 | 0.010 | 0.003 | 11.8 | 0.37 | 2.63 | 0.015 | 0.049 | - | 8.10 | 850 | **775** |
| | 21 | 0.033 | 0.20 | 0.21 | 0.010 | 0.003 | 11.8 | 0.37 | 2.63 | 0.015 | 0.049 | - | 8.10 | 800 | **525** |
| | 22 | 0.029 | 0.20 | 0.21 | 0.006 | 0.002 | 11.6 | 0.18 | 2.20 | 0.015 | 0.040 | - | 8.26 | 850 | **525** |
| | 23 | 0.029 | 0.20 | 0.21 | 0.006 | 0.002 | 11.6 | 0.18 | 2.20 | 0.015 | 0.040 | - | 8.26 | 850 | **725** |
| | 24 | 0.032 | 0.20 | 0.21 | 0.010 | 0.002 | 11.8 | 0.38 | 2.32 | 0.015 | 0.048 | - | 8.45 | 850 | **525** |
| | 25 | 0.032 | 0.20 | 0.21 | 0.010 | 0.002 | 11.8 | 0.38 | 2.32 | 0.015 | 0.048 | - | 8.45 | 800 | **525** |
| | 26 | 0.030 | 0.21 | 0.20 | 0.007 | 0.002 | 11.4 | **0.00** | 2.50 | 0.015 | 0.051 | - | 7.55 | 850 | 625 |
| | 27 | 0.030 | 0.21 | 0.20 | 0.007 | 0.002 | 11.4 | **0.00** | 2.50 | 0.015 | 0.051 | - | 7.55 | 800 | 650 |
| | 28 | 0.029 | 0.20 | 0.21 | 0.006 | 0.002 | 11.5 | **0.01** | 2.19 | 0.014 | 0.046 | - | 8.03 | 850 | 625 |
| | 29 | 0.029 | 0.20 | 0.21 | 0.006 | 0.002 | 11.5 | **0.01** | 2.19 | 0.014 | 0.046 | - | 8.03 | 800 | 650 |
| | 30 | 0.032 | 0.20 | 0.21 | 0.008 | 0.002 | 11.6 | 0.21 | 2.38 | 0.015 | 0.055 | 0.3Cu | 8.02 | 800 | **525** |
| | 31 | 0.032 | 0.20 | 0.21 | 0.008 | 0.002 | 11.6 | 0.21 | 2.38 | 0.015 | 0.055 | 0.02Nb | 8.02 | 800 | **525** |
| | 32 | 0.033 | 0.20 | 0.21 | 0.006 | 0.002 | 11.6 | 0.23 | 2.35 | 0.015 | 0.052 | 0.07V | 8.04 | 800 | **525** |
| | 33 | 0.033 | 0.20 | 0.21 | 0.006 | 0.002 | 11.6 | 0.23 | 2.35 | 0.015 | 0.052 | 0.005B | 8.04 | 800 | **525** |
| | 34 | 0.033 | 0.20 | 0.21 | 0.006 | 0.002 | 11.6 | 0.23 | 2.35 | 0.015 | 0.052 | 0.003Ca | 8.04 | 800 | **525** |
| | 35 | 0.036 | 0.21 | 0.22 | 0.006 | 0.001 | 11.6 | 0.47 | 2.04 | 0.015 | 0.052 | 0.002TI | 8.50 | 895 | **703** |

Hatched and Boldface indicate without the range of the present invention

TABLE 4

| | No. | Yield strength (MPa) | vE-40 (J) | Corrosion rate (mm/y) | Total evaluation |
|---|---|---|---|---|---|
| Steels of the comaparative example | 19 | **773** | 227 | 0.05 | x |
| | 20 | **879** | 260 | 0.04 | x |
| | 21 | **792** | **180** | 0.03 | x |
| | 22 | **929** | 219 | 0.03 | x |
| | 23 | **907** | **176** | 0.07 | x |
| | 24 | **586** | 264 | 0.06 | x |
| | 25 | **888** | 213 | 0.05 | x |
| | 26 | **930** | 241 | 0.06 | x |
| | 27 | 677 | **190** | 0.06 | x |
| | 28 | 655 | **198** | 0.06 | x |
| | 29 | 674 | **151** | 0.07 | x |
| | 30 | **643** | 211 | 0.08 | x |
| | 32 | **905** | **192** | 0.04 | x |
| | 33 | **917** | 220 | 0.05 | x |
| | 34 | **953** | 203 | 0.04 | x |
| | 35 | **891** | 201 | 0.03 | x |
| | 36 | **911** | 212 | 0.04 | x |
| | 37 | **625** | **148** | NA | x |

Hatched and Boldface indicate without range of the present invention
NA: not determined All of the steels of working examples according to the present invention and the steels of comparative examples were vacuum melted using a laboratory furnace, and the obtained ingots were hot rolled to 12 mm-thick plates. Each of plates was heat-treated, and was tested to determine strength, toughness, and corrosion resistance. Regarding the strength, round bar samples of ASTM Type F were cut from the center portion in the thickness direction of the plate, and The acceptable target values were 655 to 758 MPa of yield strength for the strength, 200 J or higher absorbed energy ($vE_{-40}$) at −40° C. for the toughness, and 0.3 mm/year or less of corrosion rate for the corrosion resistance.

In Tables 1-4, the Steels Nos. 1-17, which were within the range of the present invention in terms of both the chemical compositions and the manufacturing conditions, were proved to have satisfactory strength, toughness, and corrosion resistance. On the other hand, the Steels Nos. 18-35, which were outside the range of the present invention in terms of chemical compositions or manufacturing conditions, failed to achieve the target properties of either the strength or the toughness, or both of them. In particular, the Steels Nos. 26-29 which contained Mo outside the range of the Mo content according to the present invention could not achieve sufficient absorbed energy at −40° C. or sufficient strength even if they were subjected to heat treatment within the range of the present invention.

Effect of the Invention

The present invention improves the properties required for the seamless pipes by specifying the chemical compositions and the manufacturing conditions. As a result, the present invention provides a martensitic stainless steel of 655 MPa grade for seamless steel pipes suitable for use under high $CO_2$ environments and having high toughness, with low cost.

The invention claimed is:

1. A 655 MPa grade martensitic stainless steel without containing Nb, having high toughness, comprising C: 0.029-0.05%, Si: 0.1-0.5%, Mn: 0.1-2.0%, P: 0.05% or less, S:

0.005% or less, Cr: 10.0-12.5%, Mo: 0.1-0.5%, Ni: 2.2-3.0%, N: 0.02% or less, Al: 0.01-0.1% by weight, wherein the 655 MPa grade martensitic stainless steel has an FI value, defined by the formula [FI=Cr+Mo−Ni−30 (C+N)], of 7.93 to 8.45 and a balance of substantially Fe, wherein the 655 MPa grade martensitic steel is characterized by having a single phase martensite with a delta ferrite of below 0.13%.

2. The 655 MPa grade martensitic stainless steel without containing Nb, having high toughness according to claim 1, further comprising at least one chemical composition, selected from the group consisting of Cu: 0.5% or less V: 0.1% or less, B: 0.005% or less, Ca; 0.005% or less, by weight.

3. A method for manufacturing a 655 MPa grade martensitic stainless steel without containing Nb, having high toughness, comprising the steps of:

hot-rolling a steel, comprising C: 0.029-0.05%, Si: 0.1-0.5%, Mn: 0.1-2.0%, P: 0.05% or less, S: 0.005% or less, Cr: 10.0-12.5%, Mo: 0.1-0.5%, Ni: 2.2-3.0%, N: 0.02% or less, Al: 0.01-0.1%, by weight, wherein the 655 NPa grade martensitic stainless steel has an FI value defined by the formula [FI=Cr+Mo−Ni−30 (C+N)], of 7.93 to 8.45, and a balance of substantially Fe and wherein the 655 MPa grade martensitic steel is characterized by having a single phase martensite with a delta ferrite of below 0.13%;

cooling the hot-rolled steel;

reheating the cooled steel at temperatures from 780° C. to 960° C;

quenching the reheated steel; and tempering the quenched steel at temperatures from 550° C. to 650° C.

4. The method for manufacturing the 655 MPa grade martens.itic stainless steel without containing Nb, having high toughness according to claim 3, wherein the steel further comprises at least one chemical composition selected from the group consisting of Cu: 0.5% or less, V: 0,1% or less, B: 0.005% or less, Ca: 0.005% or less, by weight.

5. A 655 MPa grade martensitic stainless steel having high toughness, consisting of C: 0.029-0.05%,
Si: 0.1-0.5%,
Mn: 0.1-2.0%,
P: 0.05% or less,
S: 0.005% or less,
Cr: 10.0-12.5%,
Mo: 0.1- 0.5%,
Ni: 2.2-3.0%,
N: 0.02% or less,
Al: 0.01-0.1% by weight, while satisfying an FI value, defined by the formula [FI=Cr+Mo−Ni−30 (C+N)], of 7.93 to 8.45, and a balance of substantially Fe and wherein the 655 MPa grade martensitic steel is characterized by having a single phase martensite with a delta ferrite of below 0.13%.

6. The 655 MPa grade martensitic stainless steel of claim 1, provided that S is not more than 0.001%.

7. The method of claim 3, provided that S is not more than 0.001%.

* * * * *